US007806034B1

(12) United States Patent
Lee et al.

(10) Patent No.: US 7,806,034 B1
(45) Date of Patent: Oct. 5, 2010

(54) SAFETY PRIME FEEDING DEVICE

(76) Inventors: Richard J. Lee, 3146 Kettle Moraine Rd., Hartford, WI (US) 53207; John D. Lee, 3086 Kettle Moraine Rd., Hartford, WI (US) 53207

( * ) Notice: Subject to any disclaimer, the term of this patent is extended or adjusted under 35 U.S.C. 154(b) by 0 days.

(21) Appl. No.: 12/779,299

(22) Filed: May 13, 2010

Related U.S. Application Data

(63) Continuation-in-part of application No. 12/690,564, filed on Jan. 20, 2010, now abandoned.

(51) Int. Cl.
*F42B 33/04* (2006.01)

(52) U.S. Cl. ..... 86/37

(58) Field of Classification Search ..... 86/45, 86/46, 1.1, 23, 25, 32, 36, 37, 44, 33, 24, 86/38

See application file for complete search history.

(56) References Cited

U.S. PATENT DOCUMENTS 3,152,508 A * 10/1964 Fratila ..... 86/38
3,973,465 A * 8/1976 Bachhuber et al. ..... 86/45
4,222,305 A 9/1980 Lee
4,223,588 A * 9/1980 Simpson ..... 86/45
4,542,677 A * 9/1985 Lee ..... 86/38
4,620,472 A * 11/1986 Dillon ..... 86/27
4,632,008 A * 12/1986 Horner ..... 86/24
5,335,578 A * 8/1994 Lorden et al. ..... 86/45
5,435,223 A 7/1995 Blodgett et al.
6,260,463 B1 * 7/2001 Brand et al. ..... 86/37
7,694,618 B1 * 4/2010 Lee ..... 86/32

* cited by examiner

*Primary Examiner*—Michael Carone
*Assistant Examiner*—Jonathan C Weber
(74) *Attorney, Agent, or Firm*—Donald J. Ersler

(57) ABSTRACT

A safety prime feeding device includes a tray base, a tray cover, a bearing yoke, a priming pin and an elevator pin. The tray base includes a primer tray and an attachment projection that extends from the tray base. Primers are loaded into the primer tray. A primer slot is formed in a top of the attachment projection. The elevator pin pushes a primer to the primer slot above the primer tray for transfer of the primer to the priming pin. The priming pin and elevator pin are retained by the bearing yoke. A primer barrier is formed in the primer tray adjacent the elevator pin. An actuator body includes a tray retaining body, a lever and a connecting rod. The attachment projection is retained by the tray retaining body. Squeezing the lever pushes the connecting rod, which pushes the bearing yoke to push the primer into the cartridge.

20 Claims, 6 Drawing Sheets

Fig. 4
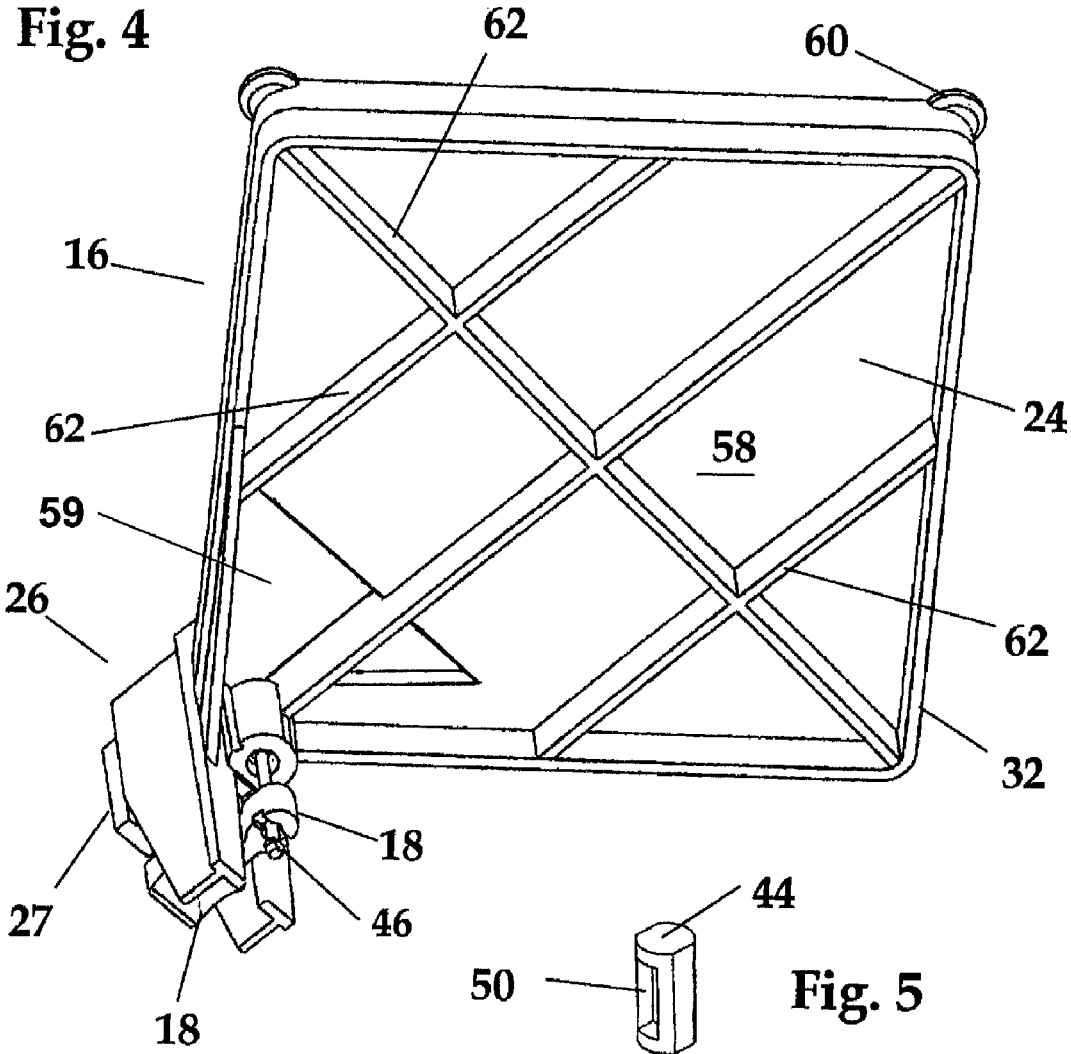
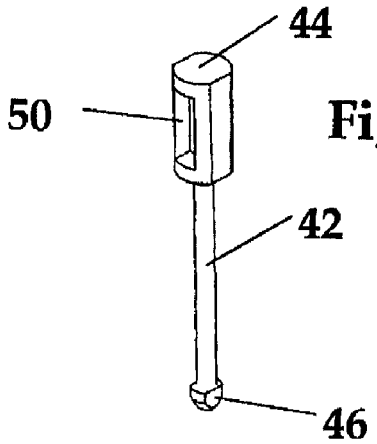
Fig. 5
Fig. 6
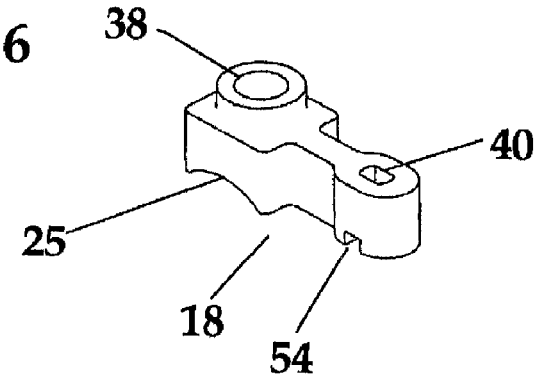

SAFETY PRIME FEEDING DEVICE

CROSS-REFERENCES TO RELATED APPLICATIONS

This is a continuation-in-part patent application taking priority from nonprovisional application Ser. No. 12/690,564 filed on Jan. 20, 2010 now abandoned.

BACKGROUND OF THE INVENTION

1. Field of the Invention The present invention relates generally to reloading ammunition and more specifically to a safety prime feeding device, which prevents primers in a loading tray from igniting if the primer being installed into a cartridge case explodes.

2. Discussion of the Prior Art

U.S. Pat. No. 4,222,305 to Lee discloses a tool for installing primers in ammunition cartridges. The Lee patent includes an elongated body, a carrier element engageable with the body, a primer cap driving pin slidable in the cartridge element, a shell holder support in the body, a hand operating lever and a toggle link pivotal retained on the hand operating lever. U.S. Pat. No. 5,435,223 to Blodgett et al. discloses a cartridge priming device with safety guard. The Blodgett et al. includes a primer receiving station for holding a single primer for insertion into a cartridge, a primer reservoir operable to hold a plurality of primers, a primer passage for directing primers from the reservoir to the primer receiving station and a guard shiftable to protect the primer passage.

Accordingly, there is a clearly felt need in the art for a safety prime feeding device, which isolates a primer being loaded into a cartridge case from primers in a loading tray to prevent ignition of the primers in the loading tray if the loaded primer being loaded explodes.

SUMMARY OF THE INVENTION

The present invention provides a safety prime feeding device, which prevents primers in a loading tray from igniting if the primer being loaded into a cartridge case explodes. The safety prime feeding device includes a tray base, a tray cover, a bearing yoke, a priming pin and an elevator pin. The tray base includes a primer tray and an attachment projection that extends from the tray base. A priming bore is formed through the attachment projection to slidably receive the priming pin. An elevator counterbore is formed in the attachment projection, adjacent the priming bore.

A primer channel is formed adjacent a peripheral side wall of the primer tray. Primers are loaded into an open end of the primer channel. The other end of the primer channel communicates with the elevator counterbore. A primer barrier extends upward from a bottom of the primer tray, adjacent the primer channel. The primer barrier ensures that a separation distance is kept between the plurality of primers in the primer tray and the priming pin. The separation distance prevents any explosion that may occur, while inserting a primer into a cartridge case from igniting the plurality of primers in the primer tray. A primer slot is formed on a top of the attachment projection. One end of the primer slot communicates with the elevator counterbore and the other end of the primer slot communicates with priming bore.

The bearing yoke includes a priming pin bore and an elevator pin opening. The elevator pin is dropped into the elevator counterbore. An elevator spring is slipped over the elevator pin. One end of the priming pin is pressed into the priming pin bore. A priming pin spring is placed over the pin. The priming pin is inserted into the priming bore and the elevator pin is inserted through the elevator pin opening and the elevator pin is turned 90 degrees to retain thereof in the bearing yoke.

An actuator body includes a tray retaining body, a lever and a connecting rod. The tray retaining body includes a pivot insert, a shell holder slot and an attachment window. The shell holder slot is sized to receive a shell holder insert. The shell holder slot is formed in one end of the tray retaining body and a pivot insert is retained in the other end thereof. The attachment window is formed through a side wall of the tray retaining body, adjacent the shell holder slot. The tray base is attached to the tray retaining body by engaging the attachment projection in the attachment window. The lever includes a pivot end formed on one end and a rod pivot slot formed adjacent the pivot end. The connecting rod includes a first pivot end formed on a first end and a second pivot end formed on a second end. The pivot slot of the pivot insert is sized to pivotally receive the first pivot end. The rod pivot slot is sized to receive the second pivot end. A bottom of the bearing yoke includes a curved slot to receive the pivot end of the lever. The actuator body may also have alternative designs.

Accordingly, it is an object of the present invention to provide a safety prime feeding device, which isolates a primer loaded into a cartridge case from primers in a tray base.

It is a further object of the present invention to provide a safety prime feeding device, which includes a primer barrier for preventing ignition of primers in a tray base from a loaded primer that explodes.

Finally, it is another object of the present invention to provide a safety prime feeding device, which includes an elevator for preventing ignition of primers in a base tray from a loaded primer that explodes.

These and additional objects, advantages, features and benefits of the present invention will become apparent from the following specification.

BRIEF DESCRIPTION OF THE DRAWINGS

FIG. 4 is a bottom perspective view of a safety prime feeding device in accordance with the present invention.

FIG. 5 is a perspective view of an elevator pin of a safety prime feeding device in accordance with the present invention.

FIG. 6 is a perspective view of a bearing yoke of a safety prime feeding device in accordance with the present invention.

FIG. 7*a* is a perspective view of a portion of an actuator body for receiving a safety prime feeding device in accordance with the present invention.

DETAILED DESCRIPTION OF THE PREFERRED EMBODIMENTS

Figure 1:
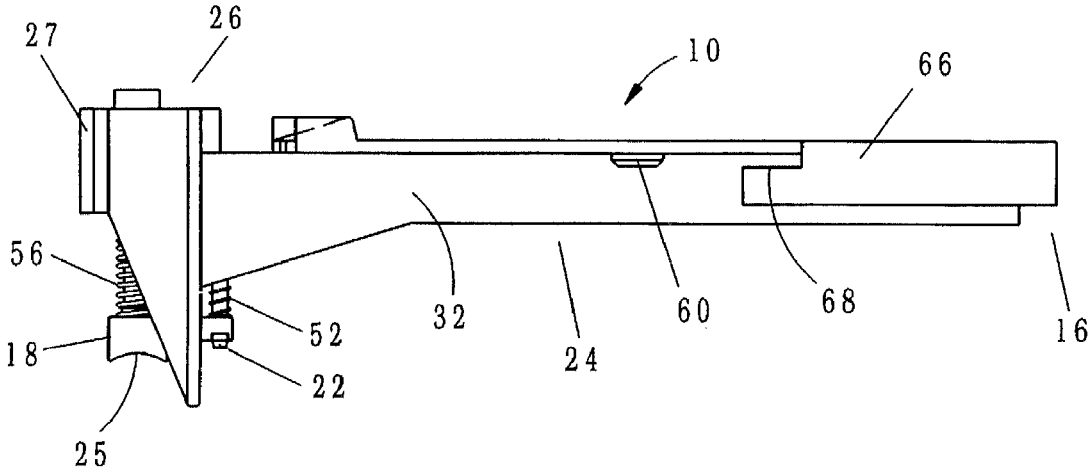
FIG. 1 is a side view of a safety prime feeding device in accordance with the present invention.
Figure 2:
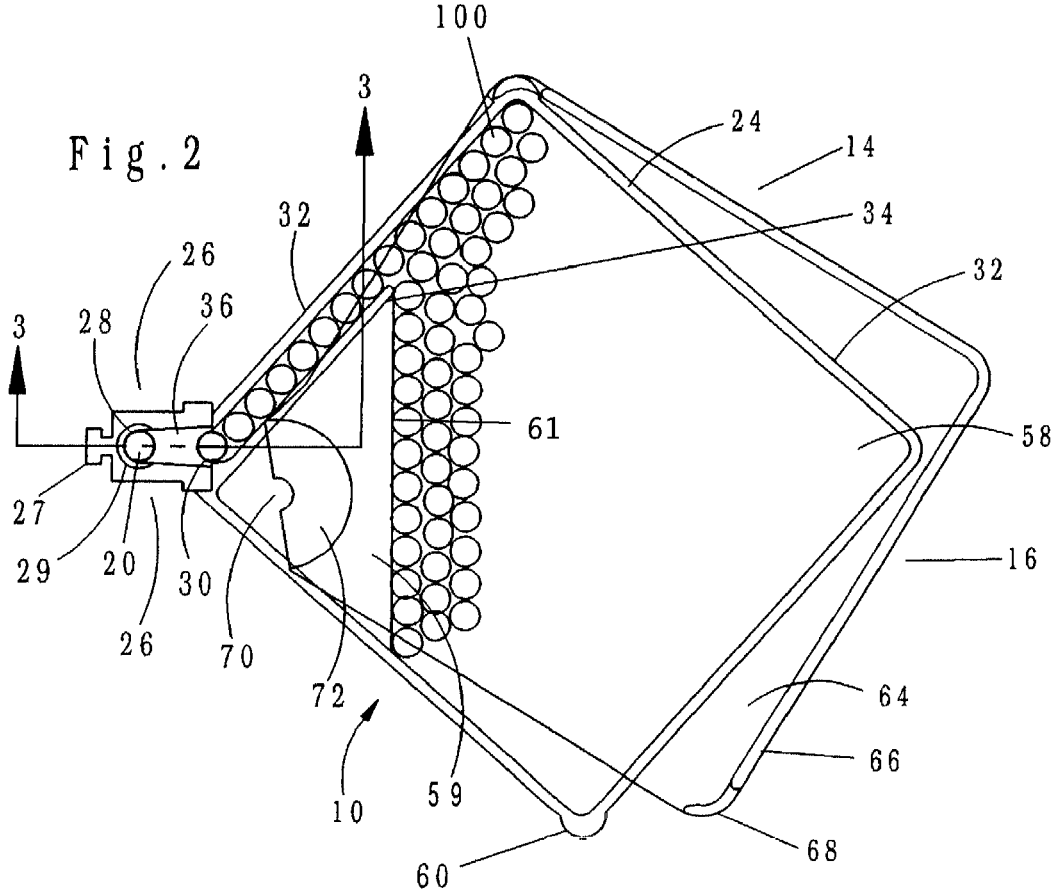
FIG. 2 is a top view of a safety prime feeding device in accordance with the present invention.
Figure 3:
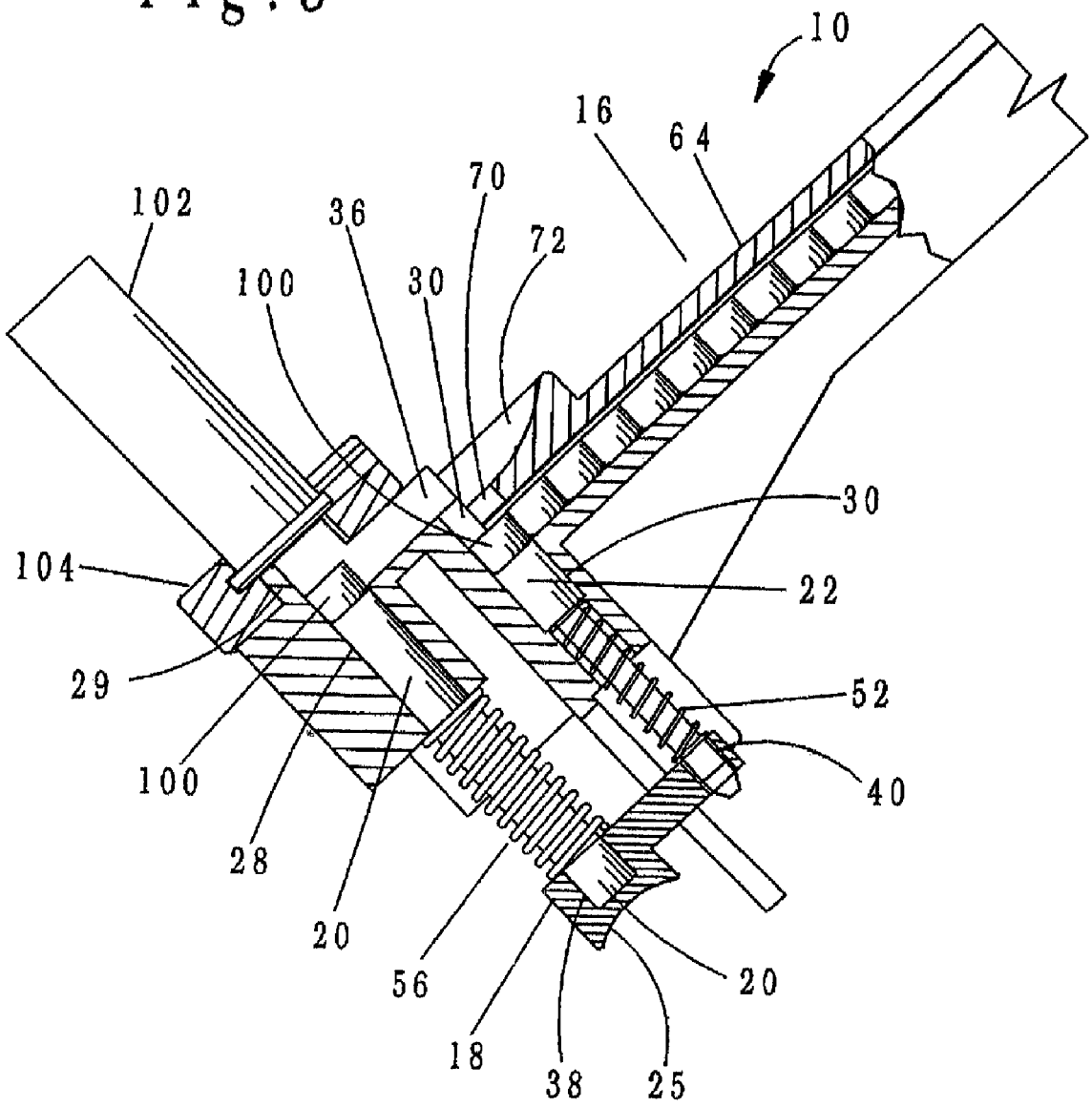
FIG. 3 is a side partial cross sectional view of a safety prime feeding device in accordance with the present invention.
Figure 7:
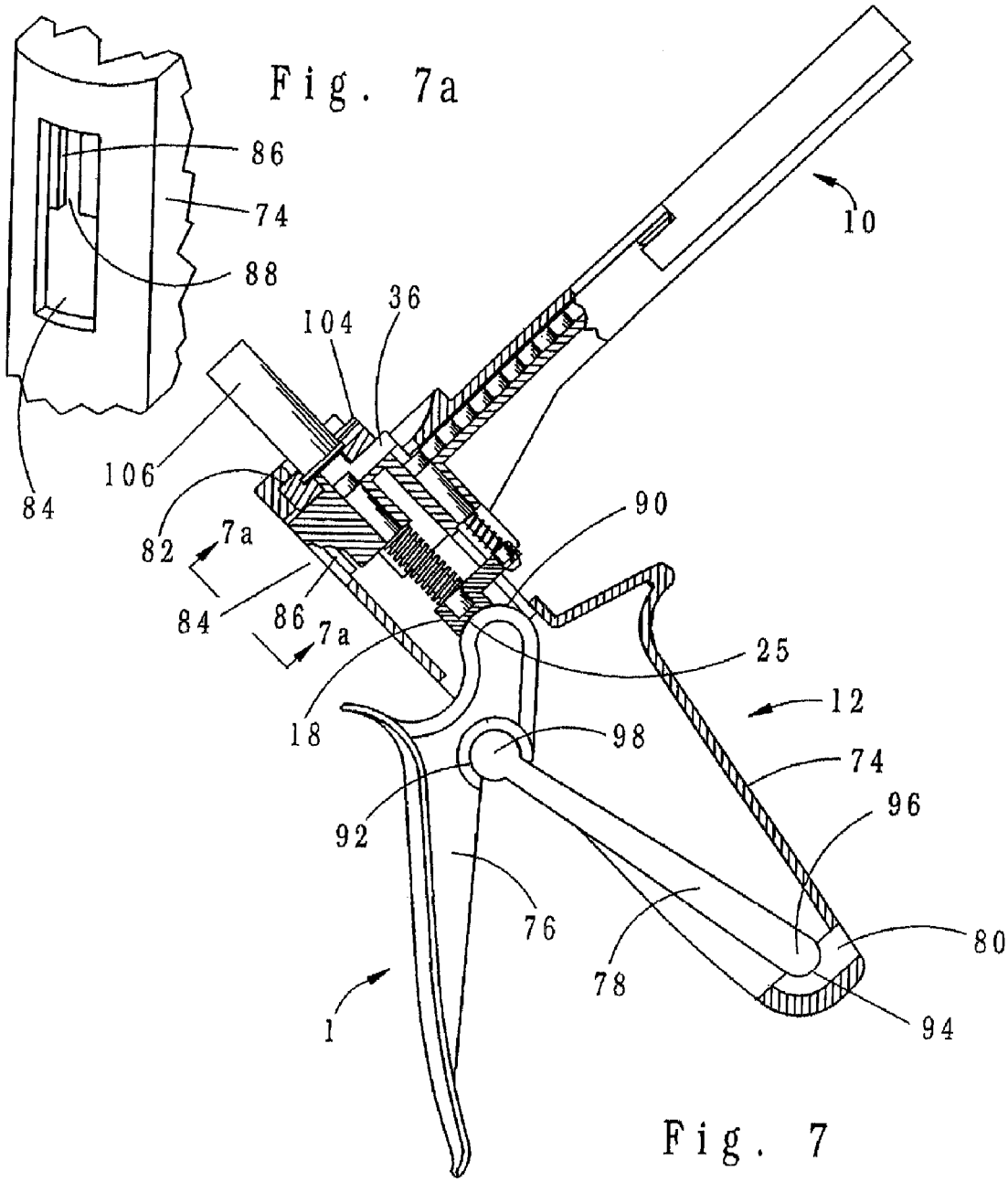
FIG. 7 is a cross sectional side view of an actuator body and a side view of a safety prime feeding device in accordance with the present invention.

With reference now to the drawings, and particularly to FIG. 7, there is shown a side view of a safety prime feeding device 10 and a cross sectional side view of an actuator body 12. With reference to FIGS. 1-4, the safety prime feeding device 10 includes a tray base 14, a tray cover 16, a bearing yoke 18, a priming pin 20 and an elevator pin 22. The tray base 14 includes a primer tray 24 and an attachment projection 26, which extends from the tray base 14. A T-shaped projection 27 extends from an end of the attachment projection 26 for retention by the actuator body 12. A priming bore 28 is formed through the attachment projection 26 to slidably receive the priming pin 20. An elevator counterbore 30 is formed in the attachment projection 26, adjacent the priming bore 28 to slidably receive the elevator pin 22.

A primer channel 34 is formed adjacent a peripheral side wall 32 of the primer tray 24. A plurality of primers 100 are loaded into an open end of the primer channel 34. The other end of the primer channel 34 communicates with the elevator counterbore 30. A primer slot 36 is formed on a top of the attachment projection 26. One end of the primer slot 36 communicates with the elevator counterbore 30. The other end of the primer slot 36 communicates with priming bore 28.

With reference to FIGS. 5-6, the bearing yoke 18 includes a priming pin bore 38 and an elevator pin opening 40. The elevator pin 22 includes a lengthwise member 42, a bore bearing member 44' and an end member 46. The bore bearing member 44 extends from one end of the lengthwise member 42 and the end member 46 extends from the other end of the lengthwise member 42.

The bore bearing member 44 is sized to be slidably received by the elevator counterbore 30. Material may be removed from areas 48 and 50 of the bore bearing member to improve moldability. A diameter of the lengthwise member 42 is the same or less than a width of the end member 46. The bore bearing member 44 is inserted into the elevator counterbore 30. The priming pin 20 is then pressed into the priming pin bore 38. The priming pin 20 is inserted into a priming pin spring 56. The priming pin 20 is slid into the priming bore 28. The elevator pin 22 is inserted into the elevator counterbore 30. The elevator spring 52 is slipped over the end member 46, before the end member 46 is inserted into the elevator pin opening 40. The elevator pin 22 is turned 90 degrees, such that the end member 46 is received by a cross slot 54.

The primer tray 24 preferably includes the peripheral side wall 32, a primer tray support 58, a primer barrier 59 and a pair of cover projections 60. The peripheral side wall 32 around substantially all of the primer tray support 58. The peripheral side wall 32 also extends above and below the primer tray support 58. A plurality of strengthening ribs 62 preferably extend from a bottom of the primer tray support 58. The pair of cover projections 60 extend from opposing corners of the peripheral side wall 32.

A primer barrier 59 extends upward from a bottom of the primer tray 24, adjacent the primer channel 34. The primer barrier 59 is formed by raising a portion of the primer tray support 58 upward, such that the plurality of primers 100 cannot be retained on a top of the primer barrier 59, when the tray cover 16 is snapped on to the primer tray 24. The primer barrier 59 ensures that a separation distance is kept between the plurality of primers 100 in the primer tray 24 and the priming pin 20. The separation distance between the priming pin 20 and a barrier edge 61 of the primer barrier 59 prevents any explosion that occurs, while inserting a primer 100 into a cartridge case 102 from igniting the plurality of primers 100 in the primer tray 24. A satisfactory separation distance between the priming pin 20 and the barrier edge 61 for preventing ignition of the plurality of primers 100 is between 7-9 primers 100, depending on size, but other separation distances could also be used.

The tray cover 16 includes a cover plate 64 and a partial peripheral side wall 66 that extends downward from a perimeter of the cover plate 64. A pair of projection slots 68 are formed in opposing corners of the peripheral side wall 66 to receive the pair of cover projections 60. Both ends of the partial peripheral side wall 66 are snapped over the two opposing corners of the primer tray 24. A primer clearance opening 70 and a primer explosion diversion cavity 72 are formed in a corner of the tray plate 64, adjacent the elevator bore 30. The primer clearance opening 70 provides clearance for a primer to be elevated over the cover plate 64. The primer explosion diversion cavity 72 preferably has a concave shape to deflect a possible explosion or ignition that would occur during the insertion of a primer 100 into the cartridge case 102. A bottom of the primer slot 36 is located above an entrance to the diversion cavity 72. The tray cover 16 is preferably fabricated from a clear plastic material to allow the location of the plurality of primers 100 to be viewed.

With reference to FIGS. 7-7*a*, an actuator body 12 includes a tray retaining body 74, a lever 76 and a connecting rod 78. The tray retaining body 74 includes a pivot insert 80, a shell holder slot 82 and an attachment window 84. The shell holder slot 82 is sized to receive a shell holder insert 104. A semicircular wall 29 extends upward from the attachment projection 26, concentric with the priming bore 28 to retain the shell holder insert 104 in the shell holder slot 82. The shell holder insert 104 is sized to receive a particular size of cartridge case 102. The shell holder slot 82 is formed in one end of the tray retaining body 74 and the pivot insert 80 is retained in the other end thereof. The attachment window 84 is formed through a side wall of the tray retaining body 74, adjacent the shell holder slot 82. A pair of retention plates 86 are formed behind the attachment window 84. A retention slot 88 is formed between the pair of retention plates to retain the T-shaped projection 27.

The tray base 14 is attached to the tray retaining body 74 by inserting the T-shaped projection 27 through the attachment window 84 and sliding the T-shaped projection 27 into the retention slot 88. The lever 76 includes a pivot end 90 formed on one and a rod pivot slot 92 formed adjacent the pivot end 90. The pivot insert 80 includes a pivot slot 94. The pivot insert 80 is preferably fabricated from a compressible material. The connecting rod 78 includes a first pivot end 96 formed on a first end and a second pivot end 98 formed on a second end. The pivot slot 94 is sized to pivotally receive the first pivot end 96. The rod pivot slot 92 is sized to pivotally receive the second pivot end 98. A curved slot 25 is formed in a bottom of the bearing yoke 18 to receive the pivot end 90. The actuator body 12 must be held at an angle as shown in FIG. 7, such that the primer 100 slides down the primer slot 36, when a top of the elevator pin is flush with the primer slot 36. Squeezing the lever 76 toward the tray retaining body 74 causes the primer 100 to be inserted into the cartridge case 102 and a new primer 100 to be lifted to the primer slot 36.

Figure 8:
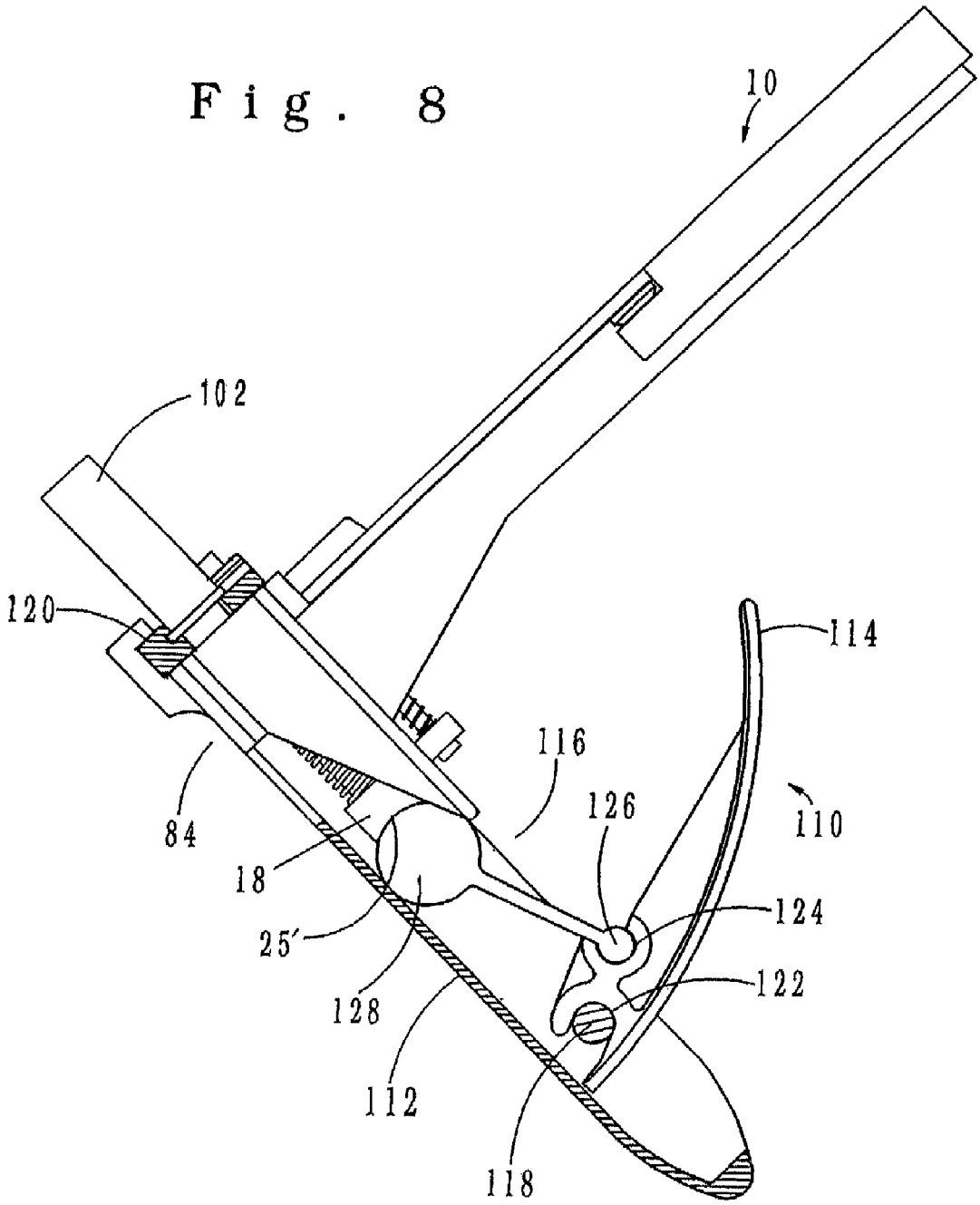
FIG. 8 is a cross sectional side view of a thumb operated actuator body and a side view of a safety prime feeding device in accordance with the present invention.

With reference to FIG. 8, the safety prime feeding device 10 is retained by a thumb operated actuator body 110. The thumb operated actuator body 110 includes a tray retaining body 112, a lever 114 and a connecting rod 116. The tray retaining body 112 includes a pivot pin 118, a shell holder slot 120 and the attachment window 84. The shell holder slot 120 is sized to receive a shell holder insert 104. The shell holder slot 120 is formed in one end of the tray retaining body 112 and the pivot pin 118 is retained in substantially the other end thereof. The attachment window 84 is formed through a side wall of the tray retaining body 112, adjacent the shell holder slot 120.

The tray base 14 is attached to the tray retaining body 74 by inserting the T-shaped projection 27 through the attachment window 84 and sliding the T-shaped projection 27 into the retention slot 88. The lever 114 includes a pivot pin slot 122 formed on one and a rod pivot slot 124 formed adjacent the pivot pin slot 122. The connecting rod 116 includes a first pivot end 126 formed on a first end and a second pivot end 128 formed on a second end. The rod pivot slot 124 is sized to pivotally receive the first pivot end 126. The second pivot end 128 is sized to be pivotally received by the curved slot 25' of the bearing yoke 18. The actuator body 110 must be held at an angle as shown in FIG. 8, such that the primer 100 slides down the primer slot 36, when a top of the elevator pin is flush with the primer slot 36. Forcing the lever 114 against the tray retaining body 112 causes the primer 100 to be inserted into the cartridge case 102 and a new primer 100 to be lifted to the primer slot 36.

Figure 9:
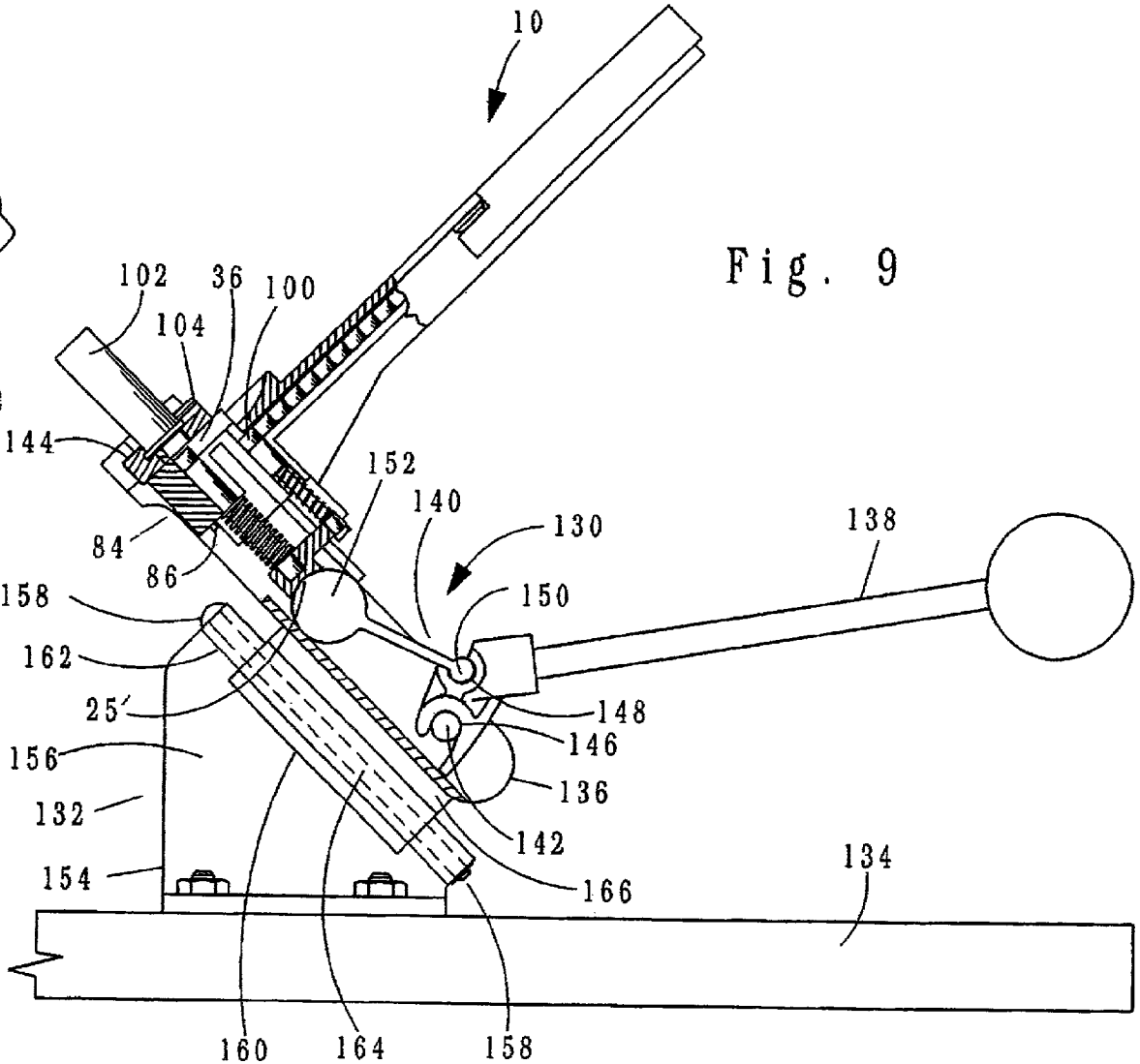
FIG. 9 is a cross sectional side view of a bench mount actuator body retained by a hinge base and a side view of a safety prime feeding device in accordance with the present invention.
Figure 10:
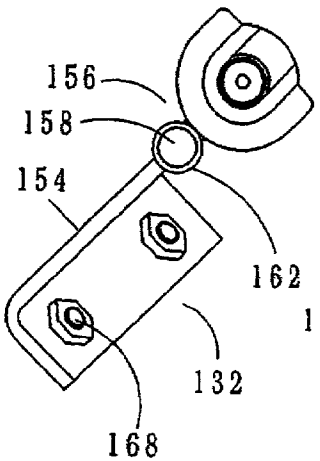
FIG. 10 is an end view of a hinge base for retaining a bench mount actuator body and a safety prime feeding device in accordance with the present invention.

With reference to FIGS. 9-10, the primer tray device 10 is retained by a bench mount actuator body 130. The bench mount actuator body 130 is retained on a bench 134 with a hinged mounting device 132. The bench mount actuator body 130 includes a tray retaining body 136, a handle lever 138 and a connecting rod 140. The tray retaining body 136 includes a pivot pin 142, a shell holder slot 144 and the attachment window 84. The shell holder slot 144 is sized to receive the shell holder insert 104. The shell holder slot 144 is formed in one end of the tray retaining body 136 and the pivot pin 142 is retained in substantially the other end thereof. The attachment window 84 is formed through a side wall of the tray retaining body 136, adjacent the shell holder slot 144.

The tray base 14 is attached to the tray retaining body 136 by inserting the T-shaped projection 27 through the attachment window 84 and sliding the T-shaped projection 27 into the retention slot 88. The handle lever 138 includes a pivot pin slot 146 formed on one end and a rod pivot slot 148 formed adjacent the pivot pin slot 146. The connecting rod 140 includes a first pivot end 150 formed on a first end and a second pivot end 152 formed on a second end. The rod pivot slot 148 is sized to pivotally receive the first pivot end 150. The second pivot end 152 is sized to be pivotally received by the curved slot 25' of the bearing yoke 18.

The hinged mounting device 132 includes an L-base 154, a hinge retainer 156 and a hinge pin 158. The L-base 154 includes a hinge clearance 160 to receive the hinge retainer 156 and a pair of curled over ends 162 to retain the hinge pin 158. The hinge retainer 156 includes a curled over end 164 and a mounting end 166. The curled over end 164 is sized to receive the hinge pin 158 and the mounting end 166 is attached to the actuator body 130 with welding or any suitable method. The L-base 154 is retained on the bench 134 with at least one fastener 168.

The actuator body 110 is retained at an angle as shown in FIG. 9, such that the primer 100 slides down the primer slot 36, when a top of the elevator pin is flush with the primer slot 36. Lifting the handle lever 138 upward causes the primer 100 to be inserted into the cartridge case 102 and a new primer 100 to be lifted to the primer slot 36.

The safety prime feeding device 10 has been disclosed for use in actuator bodies 12, 110 and 130. However, the actuator bodies should be not limited to those disclosed in this specification, but should include any design of actuator bodies, such as automated actuator bodies. Further, any device which can apply force should be considered to operate the safety prime feeding device 10.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A safety prime feeding device for use in an actuator body, comprising:

a primer tray includes a primer tray support for supporting a plurality of primers;

an attachment projection extending from an end of said primer tray;

a primer pin for inserting a primer into a cartridge is slidably retained in said attachment projection; and an elevator pin for moving a primer from the primer tray to the primer pin is slidably retained in said attachment projection adjacent said primer pin, wherein said attachment projection is retained by the actuator body.

2. The safety prime feeding device for use in an actuator body of claim 1, further comprising:

a primer slot is formed on a top of said attachment projection, one of the plurality of primers slides from a top of said elevator pin to a top of said primer pin.

3. The safety prime feeding device for use in an actuator body of claim 1, further comprising:

a tray cover is attached to a top of said primer tray.

4. The safety prime feeding device for use in an actuator body of claim 3 wherein:

an explosion diversion cavity is formed in an end of said tray cover to divert a potential ignition during insertion of one of the plurality of primers.

5. The safety prime feeding device for use in an actuator body of claim 3 wherein:

said tray cover is fabricated from a clear material.

6. The safety prime feeding device for use in an actuator body of claim 1, further comprising:

a bearing yoke retains one end of said primer pin and said elevator pin.

7. The safety prime feeding device for use in an actuator body of claim 1 wherein:

a primer channel is formed adjacent a peripheral side wall of said primer tray, one end of said primer channel communicates with said elevator pin.

8. A safety prime feeding device for use in an actuator body, comprising:

a primer tray includes a primer tray support for supporting a plurality of primers;

an attachment projection extending from an end of said primer tray;

a primer pin for inserting a primer into a cartridge is slidably retained in said attachment projection;

an elevator pin for moving a primer from the primer tray to the primer pin is slidably retained in said attachment projection adjacent said primer pin; and a primer barrier extending from said primer tray support adjacent said elevator pin, wherein said attachment projection is retained by the actuator body.

9. The safety prime feeding device for use in an actuator body of claim 8, further comprising:

a primer slot is formed on a top of said attachment projection, one of the plurality of primers slides from a top of said elevator pin to a top of said primer pin.

10. The safety prime feeding device for use in an actuator body of claim 8, further comprising:

a tray cover is attached to a top of said primer tray.

11. The safety prime feeding device for use in an actuator body of claim 10 wherein:

an explosion diversion cavity is formed in an end of said tray cover to divert a potential ignition during insertion of one of the plurality of primers.

12. The safety prime feeding device for use in an actuator body of claim 10 wherein:

said tray cover is fabricated from a clear material.

13. The safety prime feeding device for use in an actuator body of claim 10, further comprising:

a bearing yoke retains one end of said primer pin and said elevator pin.

14. The safety prime feeding device for use in an actuator body of claim 8 wherein:

a primer channel is formed adjacent a peripheral side wall of said primer tray, one end of said primer channel communicates with said elevator pin.

15. A safety prime feeding device for use in an actuator body, comprising:

a primer tray includes a primer tray support for supporting a plurality of primers;

a tray cover is attached to a top of said primer tray;

an attachment projection extending from an end of said primer tray;

a primer pin for inserting a primer into a cartridge is slidably retained in said attachment projection;

an elevator pin for moving a primer from the primer tray to the primer pin is slidably retained in said attachment projection adjacent said primer pin; and a primer barrier extending from said primer tray support adjacent said elevator pin, wherein said attachment projection is retained by the actuator body.

16. The safety prime feeding device for use in an actuator body of claim 15, further comprising:

a primer slot is formed on a top of said attachment projection, one of the plurality of primers slides from a top of said elevator pin to a top of said primer pin.

17. The safety prime feeding device for use in an actuator body of claim 15 wherein:

an explosion diversion cavity is formed in an end of said tray cover to divert a potential ignition during insertion of one of the plurality of primers.

18. The safety prime feeding device for use in an actuator body of claim 15 wherein:

said tray cover is fabricated from a clear material.

19. The safety prime feeding device for use in an actuator body of claim 15, further comprising:

a bearing yoke retains one end of said primer pin and said elevator pin.

20. The safety prime feeding device for use in an actuator body of claim 15 wherein:

a primer channel is formed adjacent a peripheral side wall of said primer tray, one end of said primer channel communicates with said elevator pin.

* * * * *